US007827741B2

(12) United States Patent
Davies et al.

(10) Patent No.: US 7,827,741 B2
(45) Date of Patent: Nov. 9, 2010

(54) GUY ANCHOR EQUALIZER PLATE WITH ULTRASOUND PORT

(75) Inventors: David Davies, Evansville, IN (US); Ernie Jones, Evansville, IN (US)

(73) Assignee: Electronics Research, Inc., Chandler, IN (US)

( * ) Notice: Subject to any disclaimer, the term of this patent is extended or adjusted under 35 U.S.C. 154(b) by 36 days.

(21) Appl. No.: 11/674,544

(22) Filed: Feb. 13, 2007

(65) Prior Publication Data

US 2008/0193224 A1 Aug. 14, 2008

(51) Int. Cl.
*E04H 12/20* (2006.01)

(52) U.S. Cl. ..... 52/151; 52/146; 52/155; 52/148; 52/165; 52/159; 73/862.392; 73/862.393; 73/826; 248/220.21; 248/220.41; 248/223.41; 256/66; 256/67; 256/68; 256/69; 405/258.1; 405/259.1

(58) Field of Classification Search ..... 52/146, 52/155, 147, 148, 149, 150, 151, 152, 153, 52/154, 156, 157, 158, 159, 160, 161, 162, 52/163, 164, 165, 166; 73/862.393, 862.392, 73/826; 248/300, 220.21, 220.41, 220.43, 248/223.41, 224.7, 235, 239, 247; 256/65.01, 256/66, 67, 68, 69, 70, 71, 72, 65.02, 65.03, 256/65.04, 65.05, 65.06, 65.07, 65.08, 65.09, 256/65.1, 65.11, 65.12, 65.13, 65.14, 65.15, 256/65.16; 405/258.1, 259.1

See application file for complete search history.

(56) References Cited

U.S. PATENT DOCUMENTS 684,096 A * 10/1901 Price ..... 256/47
1,474,458 A * 11/1923 Wilkison ..... 52/161
1,793,381 A * 2/1931 Vanatta et al. ..... 52/148
2,243,886 A * 6/1941 Scott ..... 52/160
2,300,375 A * 10/1942 Turner ..... 52/150
2,984,322 A * 5/1961 Nock ..... 52/690
3,049,194 A * 8/1962 Brendel ..... 52/1
3,368,319 A * 2/1968 Thomas et al. ..... 52/637
4,142,336 A * 3/1979 Gebhart ..... 52/166
4,174,595 A * 11/1979 Watson ..... 52/166
4,203,267 A * 5/1980 Langhorst ..... 52/148
4,214,983 A * 7/1980 Rule ..... 209/166
4,285,993 A * 8/1981 Green, Sr. ..... 427/195
4,435,931 A * 3/1984 Newbanks ..... 52/147

(Continued)

FOREIGN PATENT DOCUMENTS

WO WO 2008024281 A2 * 2/2008

*Primary Examiner*—Robert J Canfield
*Assistant Examiner*—Matthew J Gitlin
(74) *Attorney, Agent, or Firm*—C. Richard Martin, Esq.

(57) ABSTRACT

A device for anchoring one or more guy wires used to support a transmission tower is provided. The device includes an equalizer plate having a front surface and a back surface, and an anchor rod affixed proximal to a first end thereof such that a flat end surface of the first end of the anchor rod is completely exposed. The equalizer plate of the anchoring device includes a recess for receiving the first end of the anchor rod. The recess comprises a first elongated region having a width approximately equal to the diameter of the anchor rod, and an opening formed at an end of the elongated region. The flat end surface of the first end of the anchor rod preferably extends into the opening beyond the point where the opening meets the elongated region.

7 Claims, 3 Drawing Sheets

U.S. PATENT DOCUMENTS 4,894,937 A * 1/1990 Davis ..... 40/607.06
5,175,966 A * 1/1993 Remke et al. ..... 52/163
5,240,230 A * 8/1993 Dougherty ..... 256/31
6,311,565 B1 * 11/2001 Hinz et al. ..... 73/801
6,315,876 B1 * 11/2001 Delahoyde et al. ..... 204/196.06
6,871,455 B1 * 3/2005 Cockman et al. ..... 52/165
6,931,805 B2 * 8/2005 Gregory et al. ..... 52/296
7,097,154 B2 * 8/2006 Stevens ..... 254/233
2004/0237265 A1 * 12/2004 Goch ..... 24/136 R
2007/0022675 A1 * 2/2007 Weisman ..... 52/146

* cited by examiner

GUY ANCHOR EQUALIZER PLATE WITH ULTRASOUND PORT

FIELD OF THE INVENTION

The invention relates to an improved guy anchor equalization plate having an opening or port formed therein to permit direct access to an exposed end of an attached anchor rod. The exposed anchor rod end and port allow an ultrasound transducer to be connected directly to the exposed end of the anchor rod to assess the integrity of the anchor rod without excavating or unearthing the buried portion of the anchor rod.

BACKGROUND OF THE INVENTION

Guyed towers and poles provide elevated support for numerous RF related transmitting and receiving equipment including commercial broadcasting, telecommunications, including cellular and PCS equipment, and meteorological monitoring equipment. These structures also support telephone and electrical transmission cables. The lateral support offered to the structure by the guy wire is terminated at a steel guy wire anchor rod which in turn is terminated at a buried "dead man" style anchor block. The anchor block provides the structural resistance to counter the uplift and lateral forces transferred from the tower through the guy wires which result from the wind forces on the structure.

The sole link between the guy wires and the resisting anchor block is the guy wire anchor rod. This rod is typically a steel member with a guy wire equalizer plate welded to the upper end and a concrete embedment tail welded to the lower end. Approximately 20% of the rod is embedded in the concrete anchor and 10% extends above ground level. The remaining 70% is buried and in direct contact with the soil.

The buried portion of the anchor rod is subjected to the detrimental effects of bending stress, electrolytic and galvanic corrosion, any of which can result in the guy wire anchor failure and subsequent total tower failure. Unfortunately, tower collapse due to galvanic corrosion and subsequent anchor rod failure is a well documented and highly publicized phenomenon, the frequency of which continues to increase. In a recent advertising campaign, the National Association of Tower Erectors (NATE) recommended anchor rod inspections be completed prior to any tower work, out of concern for climber safety.

Because the critical anchor rod structural member is buried, most methods of inspection are not helpful. The current method of inspection requires excavation of at least a significant portion of the anchor rod to visually inspect the outer surface. Although this method will detect surface corrosion, it will not reveal stress fractures or other internal anomalies in the steel member. Excavation of the rod is labor intensive and requires supplemental anchor support. The excavation process also subjects the anchor rod to physical harm and the potential of injury to the protective galvanized coating. Excavation also places the worker in a potentially dangerous work position.

U.S. Pat. No. 6,311,565 issued to Hinz et al. proposed solving these shortcomings by providing methods useful for in-field (or remote) analysis of rod integrity without excavation of soil by transmitting ultrasonic energy from the above ground end of a rod to its buried end and receiving the energy returned therefrom. One drawback to this method is that the head end of the rod is welded to the equalizer plate rendering it inaccessible from the exterior of the plate. As such, before an ultrasound transducer can be placed upon the above ground end of the rod, weld material connecting the rod to the associated equalizer plate must be removed to create a small flat surface at or adjacent the head end of the rod and perpendicular to the longitudinal axis of the rod.

SUMMARY OF THE INVENTION

Accordingly, the need for safer, more cost-effective and reliable means to determine the structural integrity of buried anchor rods in situ is significant. The present invention fulfills this need by providing an unobstructed and unblemished anchor rod end surface sufficient to mount an ultrasound probe or transducer. This is accomplished by providing access to the end of the anchor rod via an opening in an equalizer plate while maintaining the structural integrity of the assembly.

According to one aspect of the present invention a device for anchoring one or more guy wires used to support a transmission tower is provided. The device includes an equalizer plate having a front surface and a back surface, and an anchor rod affixed proximal to a first end thereof such that a flat end surface of the first end of the anchor rod is completely exposed.

The anchoring device according to one alternative aspect of the invention may further comprise first and second anchor rods affixed to the respective front surface and back surface of the equalizer plate proximal to the first end thereof. The first and second anchor rods are preferably affixed to the equalizer plate by a plurality of welds.

According to another alternative embodiment of the present invention, the equalizer plate of the anchoring device includes a recess for receiving the first end of the anchor rod. The recess comprises a first elongated region having a width approximately equal to the diameter of the anchor rod, and an opening formed at an end of the elongated region. The flat end surface of the first end of the anchor rod preferably extends into the opening beyond the point where the opening meets the elongated region. The anchor rod may be affixed to the equalizer plate by a weld formed between the outer surface of the anchor rod and the elongated region of the recess in the equalizer plate. An inward projection may be provided at each point where the elongated region of the recess meets the opening. The opening may be polygonally shaped, and is preferably quadrilateral shaped.

Another aspect of the present invention is a system for assessing, without excavation, structural integrity of an anchor having an exposed first end and an unexposed second end and adapted in use to support a guyed tower with the second end buried below grade. The system comprises a means for transmitting a signal of an amplitude and type effective to transverse from the exposed first end of the anchor to the second end and provide a return signal at the first end unless prevented form doing so because of one or more flaws in the anchor. Means for assessing the structural integrity of the anchor by analyzing the return signal may also be provided. The signal is ultrasonic, the anchor is an elongated metal rod, and the first end is welded in use to a plate having an opening therein such that a flat end surface of the first end is completely exposed.

A longitudinal wave method of assessing in situ integrity of an elongated anchor rod having first and second ends is also provided. The first end of the anchor rod is positioned above ground in use and sufficiently exposed to permit high-quality acoustical coupling and the second end of the anchor rod is positioned below grade. A source of ultrasonic energy is positioned on the exposed portion of the first end, and ultrasonic energy is transmitted through the rod toward the second end. The source then receives any ultrasonic energy returned thereto. The returned ultrasonic energy may then be analyzed to detect any anomalies.

A shear wave method of assessing in situ integrity of an elongated anchor rod having first and second ends is also provided. When using this method, the first end of the anchor rod is also above ground in use, but is not necessarily unexposed, and the second end of the anchor rod is positioned below grade. A source of ultrasonic energy is positioned on an outer surface of the anchor rod substantially perpendicular to a longitudinal axis thereof, and ultrasonic energy is transmitted through the rod at a grazing angle toward the second end. The source then receives any ultrasonic energy returned thereto. The returned ultrasonic energy may then be analyzed to detect any anomalies.

Accordingly, it is an object of the present invention to provide a device that permits longitudinal wave, ultrasound examination of a buried anchor rod without excessive surface preparation or weld and/or member material removal.

It is a further object of the present invention to eliminate the need to repair the anchor shaft after examination.

It is a further object of the present invention to provide a method for longitudinal wave, ultrasound examination of a buried anchor rod without excessive surface preparation or weld and/or member material removal.

It is yet another object of the present invention to provide a method for shear wave, ultrasound examination of a buried anchor rod without excessive surface preparation or weld and/or member material removal.

These and other objects, features and advantages of the present invention will become apparent with reference to the text and the drawings of this application.

DETAILED DESCRIPTION

Figure 1:
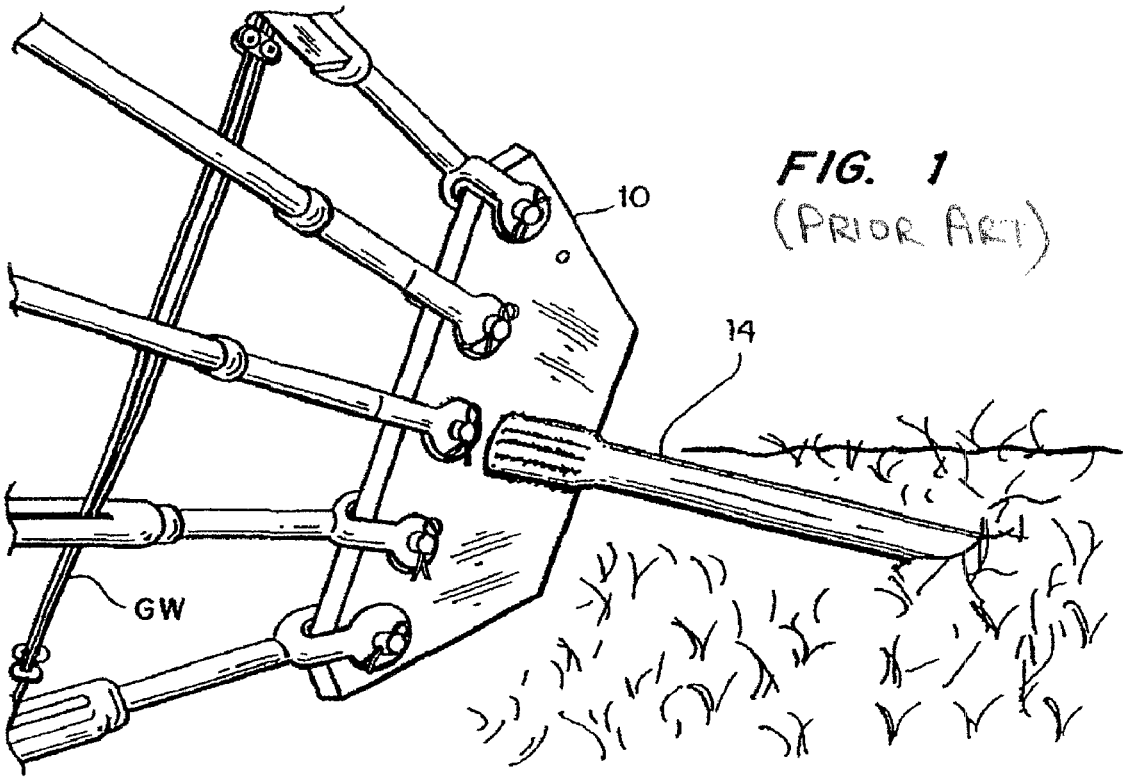
FIG. 1 (PRIOR ART)
FIG. 1 is a perspective view of an equalizer plate, guy wires, and anchor rod according to the prior art.
Figure 2:
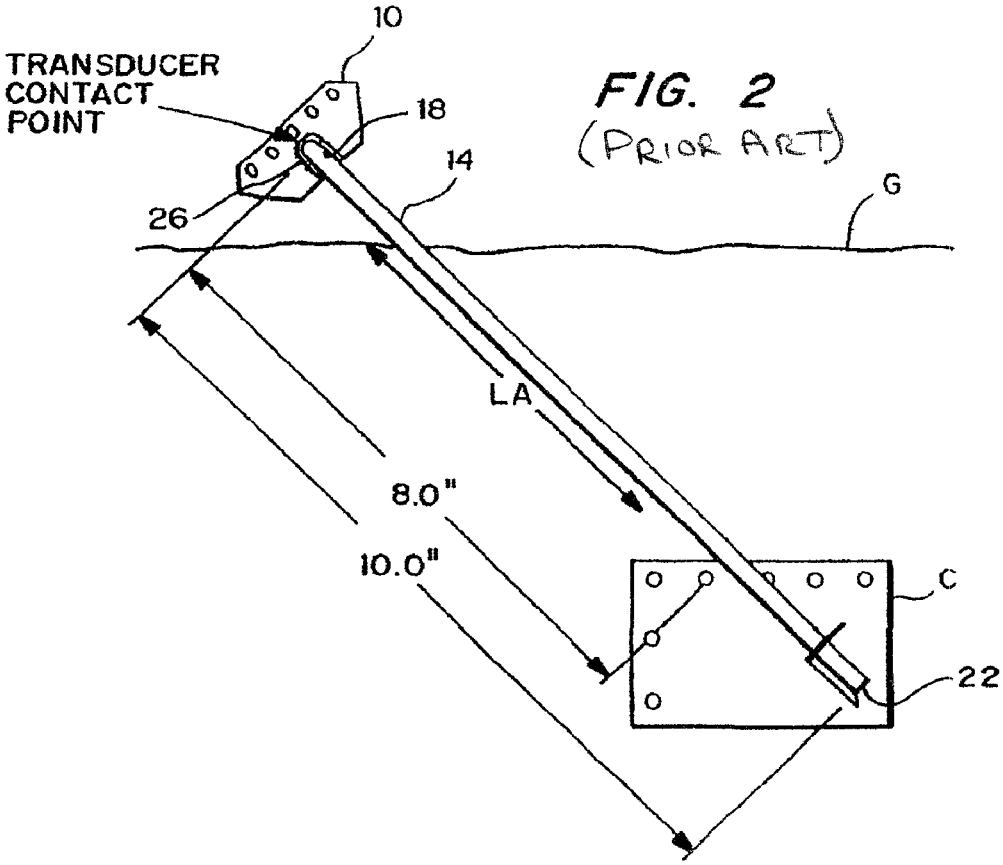
FIG. 2 (PRIOR ART)
FIG. 2 is a diagrammatic view of an equalizer plate and anchor rod according to the prior art.

FIGS. 1 and 2 illustrate a guy anchor assembly as is known in the art. The guy anchor assembly includes an equalizer plate 10 connecting a plurality of guy wires GW to an anchor rod 14. The guy wires GW connect to and support a metal tower or other similar structure. Because each guy wire GW attaches to a different location of the tower, it may experience different wind-related stresses than other guy wires GW. The equalizer plate 10 is provided to, in part equalize the effects of these different forces.

The anchor rod 14 includes a first end 18 positioned in a recess 26 located in the plate 10, and a second end 22 connected to an underground concrete anchor block C. The first end 18 of the rod 14 is preferably connected to the plate 10 at recess 26 by full penetration welds along the sides of the first end 18 and fillet welds used at the top. As a result, and as best shown in FIG. 1, the first end 18 of the rod 14 is inaccessible because of the recess and accompanying welds.

Figure 4:
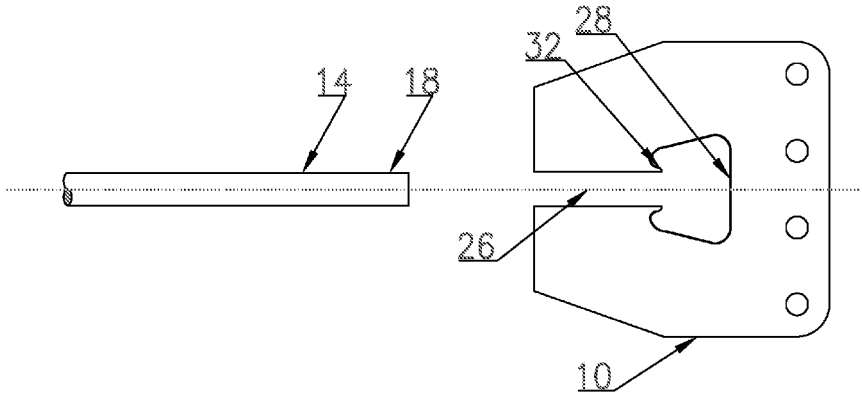
FIG. 4 is a side exploded view of the equalizer plate and anchor rod shown in FIG. 3.
Figure 3:
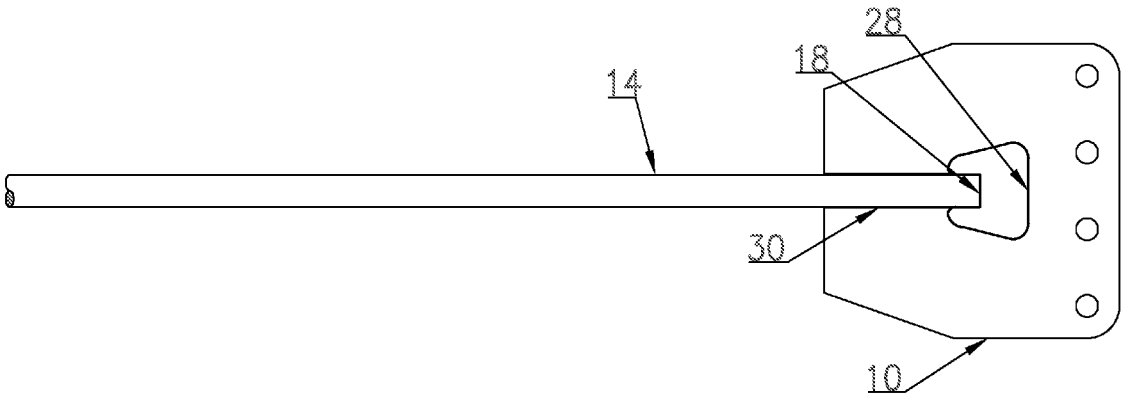
FIG. 3 is a side elevation view of an equalizer plate and anchor rod according to a first embodiment of the present invention.

As shown in FIGS. 3 and 4, the present invention remedies this issue by providing an access port or opening 28 in the equalizer plate 10 at the inner end of the recess 26. The opening 28 is sized and shaped to permit insertion of an ultrasound transducer onto the end 18 of the anchor rod 14 through the opening 28. The rod 14 is affixed to the equalizer plate 10 by welds 30 along the interfaces between the rod 14 and the recess 26. The end 18 of the anchor rod 14 preferably extends slightly into the opening such that the end 18 is relieved relative to the opening. Such a configuration provides for a better weld area, reduces weld splatter on the rod end 18, and reduces weld interference with the ultrasonic transducer.

Figure 5:
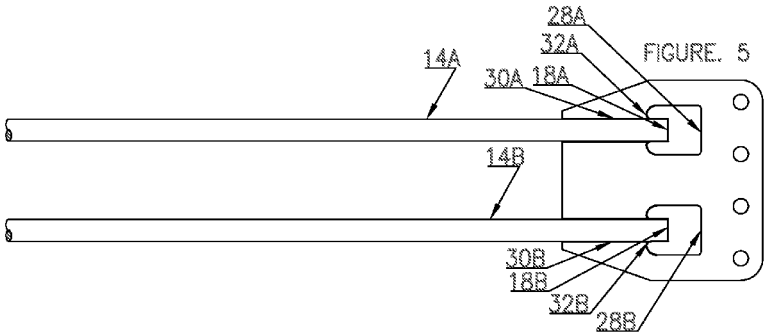
FIG. 5 is a side elevation view of an equalizer plate and anchor rods according to a second embodiment of the present invention.

As shown in FIGS. 3 and 4, the opening is preferably quadrilateral shaped with the side opposite the recess 26 being longer to accommodate insertion of a large transducer into the opening 28. The corners of the opening 28 are preferable rounded to reduce fatigue and stress on the plate 10. Likewise, at the point where the opening 28 meets the recess 26, the opening flares inwardly in projections 32. This feature provides additional structural strength to the equalizer plate and reduces the likelihood of stress risers forming at the weld joint 30. As would be readily apparent to one of skill in the art, the shape of the opening 28 is not limited to that of a quadrilateral and can take many forms so long as the dimensions of the opening permit insertion of a transducer into direct contact with the rod end 18 and the strength characteristics of the plate 10 are not compromised significantly.

Where the combination of more than one anchor rod with a single equalizer plate exists, corresponding openings can be provided in the equalizer plate for each rod. For example, as shown in FIG. 5, two anchor rods 14*a*, 14*b* are affixed to a single equalizer plate 10. Each respective anchor rod end 18*a*, 18*b* extends into a corresponding opening 28*a*, 28*b* in the equalizer plate 10. The rods 14*a*, 14*b* are affixed to the equalizer plate 10 by respective welds 30*a*, 30*b* along the interfaces between the rods 14*a*, 14*b* and the recesses. At the point where the openings 28*a*, 28*b* meet the recesses, the openings 28*a*, 28*b* flare inwardly in projections 32*a*, 32*b*. This feature provides additional structural strength to the equalizer plate and reduces the likelihood of stress risers forming at the weld joints 30*a*, 30*b*.

Figure 6:
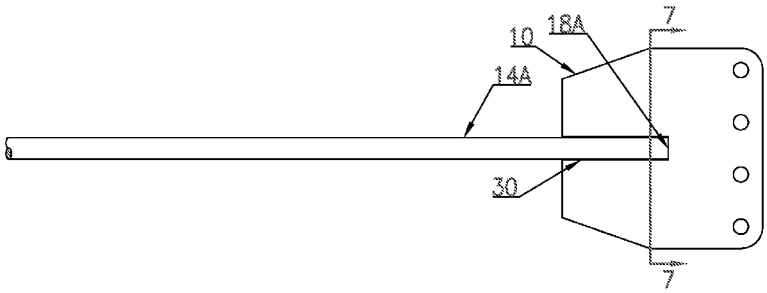
FIG. 6 is a side elevation view of an equalizer plate and anchor rods according to a third embodiment of the present invention.
Figure 7:
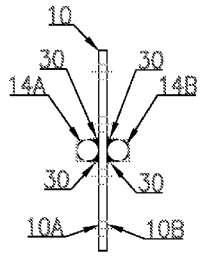
FIG. 7 is an end sectional view of the equalizer plate and anchor rods of FIG. 6 along the line 7-7.

A further alternative embodiment of the present invention is shown in FIGS. 6 and 7. According to this embodiment, a pair of anchor rods 14*a*, 14*b* are provided. A first anchor rod 14*a* is welded to a front surface 10*a* of the equalizer plate 10 and a second anchor rod 14*b* is welded to a rear surface 10*b* of the equalizer plate 10. The welds 30, extend along the length of the rod 14 that is in contact with the plate, but do not extend all the way to the rod end 18, to reduce weld splatter on the rod end and to further reduce weld interference with the transducer.

In operation, a source of ultrasonic energy, usually a transducer, is inserted through the opening 28 in the equalizer plate 10, and placed on the exposed portion of the first end 18 of the anchor rod 14. Once the transducer is in place, ultrasonic energy is transmitted through the rod toward the second end. The transducer then receives any ultrasonic energy returned to the source, and the data is analyzed to determine if there are any anomalies.

Using this longitudinal wave testing technique, we were able to identify steel material loss in a 2¼" solid steel rod, 17 feet in length. Material representing 25% of the total cross sectional area was removed from a single rod. The "wasted" area was approximately ⅓ from one end of the rod and ⅔ the distance from the other end of the rod. By using three different ultra sound test generator and transducer combinations we were able to accurately detect, in all cases, the areas with anomalies. Additionally, we were able to determine the precise distance from the front and back surface of the test rod. The tests were equally accurate from either the ⅓ distance or the ⅔ distance from the test end.

As previously discussed, and as shown in FIGS. 1 and 2, most present day anchor rod designs are not well suited for longitudinal ultra sound testing due to the equalizer plate being welded to the end of the anchor rod. The present invention provides for another method of utilizing ultra sound testing which can avoid this limitation. The Shear Wave technique of ultrasound testing connects the transducer to the side of the anchor rod 14 using a special angle-beam transducer that projects the sound beam into the shaft at a grazing angle. Using this technique we were able to detect the 25% loss of material within five feet or so from the test end of the anchor rod. We also detected a 50% loss of material at a distance of approximately 12 feet from the test end of the anchor rod. Keeping in mind these results were not as detailed as those using the longitudinal wave technique they were still considered acceptable.

One challenge in using the Shear Wave technique involves the shape of the transducer. The attachment surface of the transducer is generally flat while the outer surface of the anchor rod is a cylindrical surface. As a result, only a small fraction of the transducer surface actually making direct contact with the anchor shaft. Accordingly, the present invention anticipates providing transducer faces having a radius surface corresponding to the radius of the anchor rod in order to allow more sound beam to be directed into the anchor shaft allowing a stronger return reflection to be received. This should have the effect of increasing both the depth of the sound wave penetration and detail of the reflections.

Although the Shear Wave technique is not as accurate as the Longitudinal Wave technique, and has proven more tedious to administer, it is a viable alternative for the investigation of existing anchor rods. This technique would avoid the anchor rod surface preparation and grinding currently required in attempting to use longitudinal wave testing techniques on anchor rods with the equalizer plate welded to the exposed end of the anchor shaft. It would also avoid the post-test repair of the damage incurred to the anchor shaft that would result if longitudinal wave testing were attempted.

The foregoing is provided for purposes of illustrating, explaining, and describing embodiments of the present invention. Further modifications and adaptation to these embodiments will be apparent to those skilled in the art and may be made without departing from the scope or spirit of the invention.

We claim:

1. A device for anchoring one or more guy wires used to support a transmission tower comprising:

an equalizer plate having a front surface and a back surface; and an anchor rod affixed to said equalizer plate proximal to a first end thereof such that a flat end surface of the first end of said anchor rod is completely exposed;

wherein said equalizer plate includes a recess for receiving the first end of the anchor rod, said recess comprising a first elongated region having a width approximately equal to the diameter of the anchor rod, and an opening formed at an end of the elongated region.

2. The anchoring device of claim 1, wherein said flat end surface of the first end of said anchor rod extends into the opening beyond the point where the opening meets the elongated region.

3. The anchoring device of claim 2, wherein the anchor rod is affixed to the equalizer plate by a weld formed between the outer surface of the anchor rod and the elongated region of the recess in the equalizer plate.

4. The anchoring device of claim 2, further comprising an inward projection at each point where the elongated region of the recess meets the opening.

5. The anchoring device of claim 1, wherein the opening is polygonally shaped.

6. The anchoring device of claim 5, wherein the opening is quadrilateral shaped.

7. The anchoring device of claim 5, further comprising an inward projection at each point where the elongated region of the recess meets the opening.

* * * * *